US005631613A

United States Patent [19]

Niimi et al.

[11] Patent Number: 5,631,613

[45] Date of Patent: May 20, 1997

[54] MAGNET SWITCH FOR ENGINE STARTER

[75] Inventors: Masami Niimi; Tsutomu Shiga, both of Kariya, Japan

[73] Assignee: Nippondenso Co., Ltd., Kariya, Japan

[21] Appl. No.: 559,096

[22] Filed: Nov. 16, 1995

[30] Foreign Application Priority Data

Nov. 22, 1994 [JP] Japan ..... 6-287810
Aug. 31, 1995 [JP] Japan ..... 7-223377

[51] Int. Cl.[6] ..... H01H 67/02

[52] U.S. Cl. ..... 335/126; 335/131

[58] Field of Search ..... 335/126, 131

[56] References Cited

U.S. PATENT DOCUMENTS 4,852,417 8/1989 Tanaka .
5,245,304 9/1993 Zenmei ..... 335/126
5,424,700 6/1995 Santarelli ..... 335/131

FOREIGN PATENT DOCUMENTS 60-047321 3/1985 Japan .
6-052772 2/1994 Japan .

*Primary Examiner*—Lincoln Donovan
*Attorney, Agent, or Firm*—Cushman Darby & Cushman, IP Group of Pillsbury Madison & Sutro LLP

[57] ABSTRACT

A magnet switch for an engine starter includes a yoke made of magnetic material and having a cylindrical shape with a bottom and an opening. A coil disposed in the yoke includes an insulated electric wire. A stationary core made of magnetic material closes the opening of the yoke. A sleeve made of non-magnetic metal has a cylindrical shape. The sleeve is located between the bottom of the yoke and the stationary core. A plunger made of magnetic material is at least partially located in the sleeve. The plunger is slidable relative to the sleeve in an axial direction. The coil includes a regular winding which extends around the sleeve. The coil is compressed and held between the bottom of the yoke and the stationary core.

3 Claims, 2 Drawing Sheets

MAGNET SWITCH FOR ENGINE STARTER

BACKGROUND OF THE INVENTION

1. Field of the Invention

This invention relates to a magnet switch for an engine starter.

2. Description of the Prior Art

Japanese published unexamined patent application 6-52772 discloses a magnet switch for an engine starter. The magnet switch in Japanese application 6-52772 includes a cylindrical yoke having a partially closed bottom and an open end. The open end of the yoke is closed by a stationary core made of magnetic material. A sleeve made of non-magnetic material, such as brass, is disposed in the yoke. A plunger made of magnetic material is at least partially located in the sleeve. The plunger is slidable relative to the sleeve in an axial direction. The magnet switch in Japanese application 6-52772 includes a coil provided on a bobbin which fits around the sleeve. A coned disc spring seated between the bottom of the yoke and an end of the bobbin urges the bobbin against the stationary core to hold the bobbin in position.

U.S. Pat. No. 4,852,417 discloses an engine starter including an electromagnetic switch (a magnet switch). The electromagnetic switch in U.S. Pat. No. 4,852,417 has an exciting coil wound on a plastic bobbin supported by forward and rearward cores which form a magnetic path together with a cylindrical casing.

Japanese published unexamined patent application 60-47321 discloses a magnet switch for a starter. The magnet switch in Japanese application 60-47321 includes a pull-in coil and a holding coil wound on a bobbin made of synthetic resin. The bobbin is supported within a coil casing. Ends of the coils are electrically connected to terminals by a fusing process.

SUMMARY OF THE INVENTION

It is an object of this invention to provide an improved magnet switch for an engine starter.

A first aspect of this invention provides a magnet switch for an engine starter which comprises a yoke made of magnetic material and having a cylindrical shape with a bottom and an opening; a coil disposed in the yoke and including an insulated electric wire; a stationary core being made of magnetic material and closing the opening of the yoke; a sleeve made of non-magnetic metal and having a cylindrical shape, the sleeve being located between the bottom of the yoke and the stationary core; and a plunger made of magnetic material and being at least partially located in the sleeve, the plunger being slidable relative to the sleeve in an axial direction; wherein the coil includes a regular winding which extends around the sleeve, and the coil is compressed and held between the bottom of the yoke and the stationary core.

A second aspect of this invention is based on the first aspect thereof, and provides a magnet switch further comprising an insulating member provided between the coil and the bottom of the yoke or between the coil and the stationary core, the insulating member having a small rate of deformation responsive to a temperature variation.

A third aspect of this invention is biased on the first aspect thereof, and provides a magnet switch wherein the sleeve is made of electrically conductive metal and has an engagement projection, and the sleeve is electrically grounded, and wherein an end of the electric wire in the coil is electrically connected to the engagement projection of the sleeve to be electrically grounded via the sleeve while an insulating cover peels from the end of the electric wire.

DESCRIPTION OF THE PREFERRED EMBODIMENT

Figure 1:
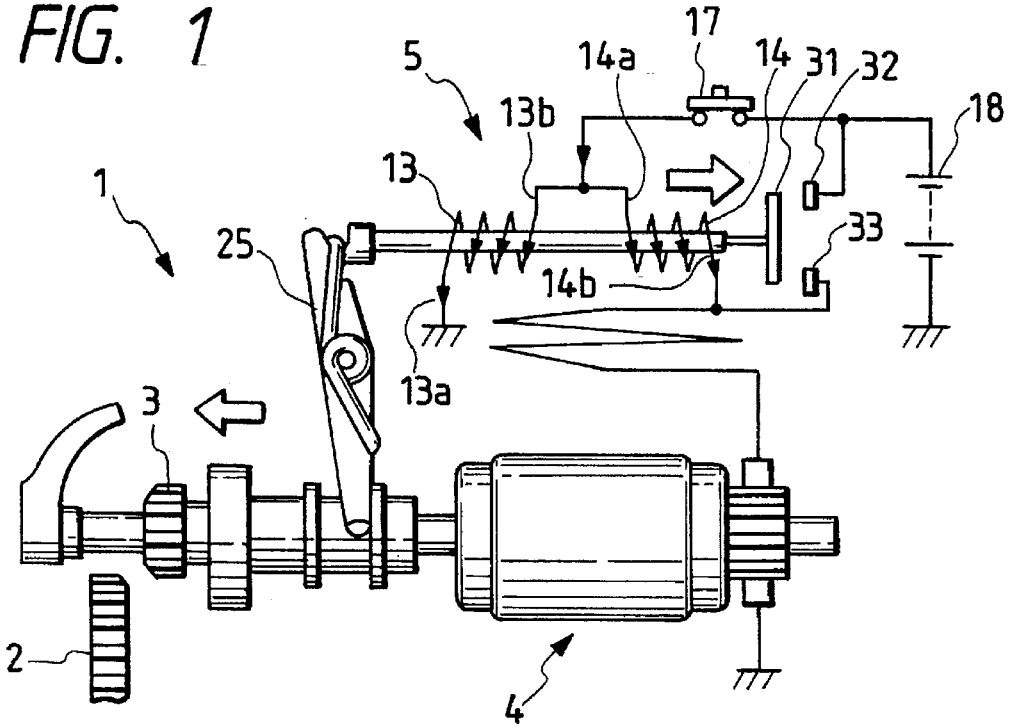
FIG. 1 is a diagram of an engine starter including a magnet switch according to an embodiment of this invention.

With reference to FIG. 1, a starter 1 for an engine (not shown) includes a pinion 3 which can move into and out of mesh with a ring gear 2. The pinion 3 is coupled to the output shaft of a starter motor 4. Therefore, the pinion 3 can be rotated by the starter motor 4. The pinion 3 can slide relative to the output shaft of the starter motor 4. The pinion 3 is connected via a key mechanism (no reference character) with a shift lever 25. The pinion 3 moves into and out of mesh with the ring gear 2 in accordance with rotation of the shift lever 25. The ring gear 2 is connected to a crankshaft (an output shaft) of the engine.

The starter 1 also includes a magnet switch 5. When the engine is required to start, the magnet switch 5 serves to move the pinion 3 into mesh with the ring gear 2 and then energize the starter motor 4. Accordingly, a rotational force is transmitted from the starter motor 4 to the engine crankshaft via the pinion 3 and the ring gear 2, and hence the engine crankshaft is rotated by the starter motor 4.

Figure 2:
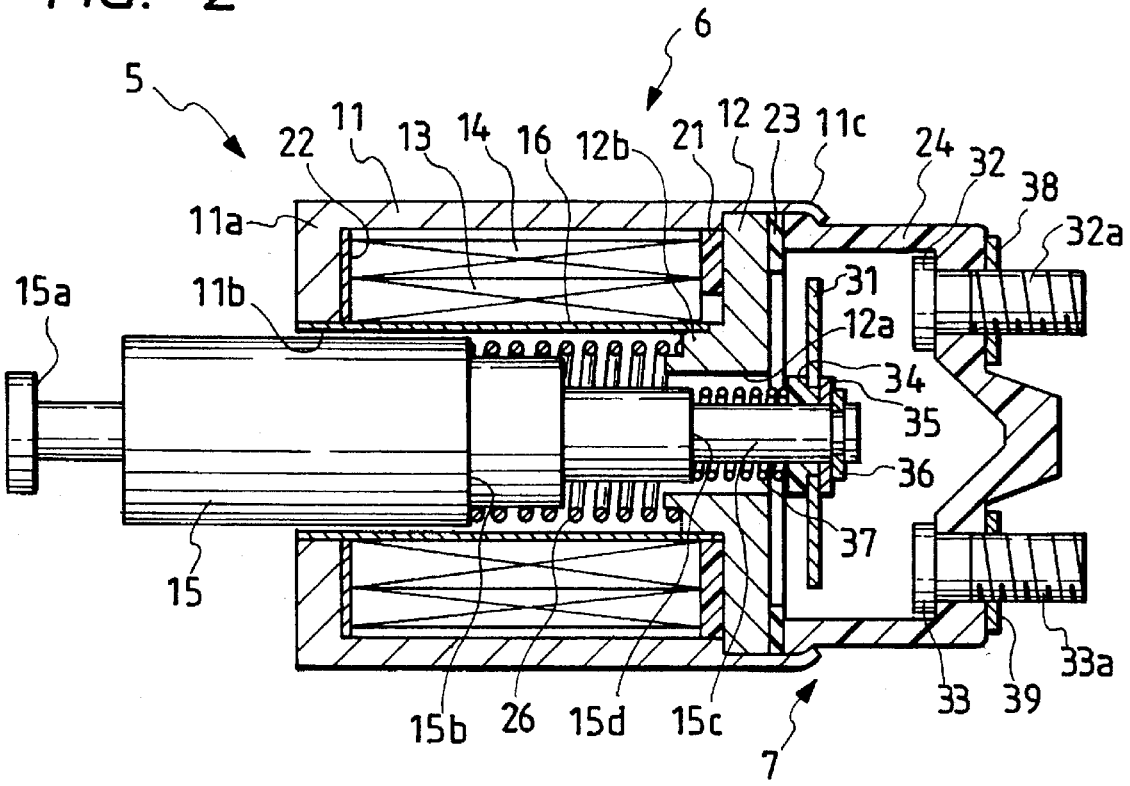
FIG. 2 is a sectional view of the magnet switch in FIG. 1.

With reference to FIGS. 1 and 2, the magnet switch 5 includes a magnet portion 6 and a switch portion 7. The magnet portion 6 serves to generate a force for moving the pinion 3 into mesh with the ring gear 2. The switch portion 7 serves to selectively energize and de-energize the starter motor 4.

It should be noted that, in FIG. 2, left-hand ends of parts are defined as front ends while right-hand ends of the parts are defined as rear ends.

The magnet portion 6 has a cylindrical yoke 11, a stator or a stationary core 12, a hold coil (winding) 13, a pull coil (winding) 14, and a plunger shaft 15. The cylindrical yoke 11 has a partially-closed end (a front end) and an open end (a rear end). The partially-closed end is referred to as the bottom 11*a*. The open end of the cylindrical yoke 11 is closed by the stationary core 12. The hold coil 13 and the pull coil 14 have cylindrical configurations coaxial with the cylindrical yoke 11. The hold coil 13 and the pull coil 14 are disposed in the cylindrical yoke 11. Specifically, the hold coil 13 and the pull coil 14 are placed in a space between the yoke bottom 11*a* and the stationary core 12. A portion of the plunger shaft 15 coaxially extends inside the hold coil 13, the pull coil 14, and the cylindrical yoke 11. The plunger shaft 15 extends through the yoke bottom 11*a* and the stationary core 12. The plunger shaft 15 can move in the axial direction with respect to the cylindrical yoke 11.

It is preferable that the bottom 11*a* and the remaining cylindrical portion of the yoke 11 are integral with each other. It should be noted that the bottom 11*a* and the remaining cylindrical portion of the yoke 11 may be separate members bonded together by, for example, a welding process.

The yoke 11 is made of magnetic metal such as low carbon steel. The yoke 11 is formed by, for example, cold forging. The bottom 11*a* of the yoke 11 has a central hole through which the plunger shaft 15 extends.

The stationary core 12 has a ring shape. The stationary core 12 is made of magnetic metal such as iron. The stationary core 12 is formed by, for example, cold forging. The stationary core 12 has a central hole 12*a* through which the plunger shaft 15 extends. The stationary core 12 has a cylindrical portion 12*b* projecting toward the yoke bottom 11*a*. As previously described, the stationary core 12 closes the open end (the rear end) of the yoke 11. The stationary core 12 constitutes a part of a core in a magnetic circuit. Specifically, the stationary core 12, the bottom 11*a* of the yoke 11, and the cylindrical walls of the yoke 11 compose the core in the magnetic circuit.

In the case where the engine is used to drive a vehicle, the yoke 11 and the stationary core 12 are electrically connected via a starter housing (not shown) to the body of the vehicle which constitutes an electrical ground. Thus, the yoke 11 and the stationary core 12 are grounded.

The hold coil 13 includes an insulated electric wire wound on a sleeve 16 coaxially disposed and supported in the cylindrical yoke 11. A rear end of the sleeve 16 fits on the cylindrical portion 12*b* of the stationary core 12. Therefore, the sleeve 16 is mechanically and electrically connected to the stationary core 12. The sleeve 16 is preferably of the seamless type. The sleeve 16 is made of non-magnetic electrically-conductive metal such as brass, copper, or aluminum. The sleeve 16 is formed by, for example, drawing. One end 13*a* of the hold coil 13 is electrically and mechanically connected to an end of the sleeve 16. As previously described, the stationary core 12 is grounded, and the sleeve 16 is electrically connected to the stationary core 12. Therefore, the end 13*a* of the hold coil 13 is grounded.

Figure 3:
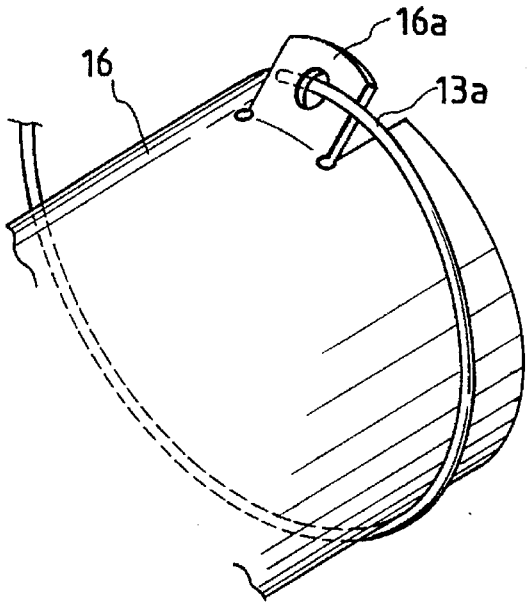
FIG. 3 is a perspective view of a sleeve and an electric wire in the embodiment of this invention.
Figure 4:
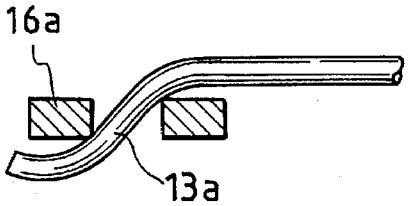
FIG. 4 is a sectional view of a portion of the sleeve and the electric wire in FIG. 3.

As shown in FIGS. 3 and 4, the rear end of the sleeve 16 has an engagement portion 16*a* formed with a hole. The engagement portion 16*a* projects from the remainder of the sleeve 16. During the assembly of the hold coil 13, one end 13*a* of the hold coil 13 is passed through the hole in the engagement portion 16*a*, being caught by the engagement portion 16*a*. Upon the attachment of the end 13*a* of the hold coil 13 to the engagement portion 16*a*, a part of the insulating cover (coating) peels from the electric wire for the hold coil 13 so that the end 13*a* of the hold coil 13 is electrically connected to the sleeve 16. In addition, the end 13*a* of the hold coil 13 is mechanically connected to the sleeve 16.

Figure 5:
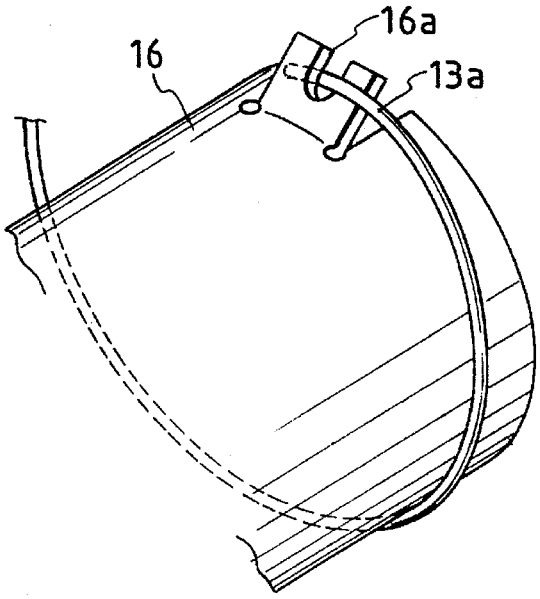
FIG. 5 is a perspective view of a modified sleeve and an electric wire in the embodiment of this invention.

It should be noted that the sleeve 16 may be modified into a structure of FIG. 5. The sleeve 16 of FIG. 5 has an engagement portion 16*a* formed with a groove instead of the hole. One end 13*a* of the hold coil 13 is passed through the groove in the engagement portion 16*a*, being caught by the engagement portion 16*a*.

As shown in FIG. 1, the other end 13*b* of the hold coil 13 is electrically connected to the positive terminal of a battery 18 (for example, a vehicle battery) via a starter switch 17. The negative terminal of the battery 18 is grounded.

The pull coil 14 includes an insulated electric wire wound around the hold coil 13. One end 14*a* of the pull coil 14 is electrically connected to the positive terminal of the battery 18 via the starter switch 17. The other end of the pull coil 14 is electrically connected to a positive input terminal of the starter motor 4. A negative input terminal of the starter motor 4 is grounded.

The hold coil 13 and the pull coil 14 are assembled as follows. One end 13*a* of the electric wire for the hold coil 13 is connected to the engagement portion 16*a* of the sleeve 16, and then an end (a rear end) of the sleeve 16 is fitted around the cylindrical portion 12*b* of the stationary core 12. Subsequently, an insulating ring 21 is fitted around the rear end of the sleeve 16. The insulating ring 21 is made of, for example, thermosetting resin. A typical example of the thermosetting resin is phenol resin. The insulating ring 21 serves to electrically isolate the hold coil 13 and the pull coil 14 from the stationary core 12. The insulating ring 21 has a recess accommodating the engagement portion 16*a* of the sleeve 16. The insulating ring 21 has a given thickness corresponding to an axial dimension of the engagement portion 16*a* of the sleeve 16.

After the insulating ring 21 is fitted around the rear end of the sleeve 16, a limiting plate (not shown) for restricting front edges of the hold coil 13 and the pull coil 14 is placed on the other end (the front end) of the sleeve 16. The axial interval between the limiting plate and the insulating ring 21 is set to a value slightly greater than the axial interval between an insulating paper 22 and the insulating ring 21 which occurs when the hold coil 13 and the pull coil 14 are assembled in the yoke 11. Subsequently, the electric wire for the hold coil 13 is regularly wound around the sleeve 16 by a given number of turns. As a result, the hold coil 13 is completed. Then, the electric wire for the pull coil 14 is regularly wound around the hold coil 13 by a given number of turns. As a result, the pull coil 14 is completed.

It is preferable that at least a first layer (an innermost layer) of the winding for the hold coil 13 is composed of regularly arranged turns. A second and later winding layers may be composed of regularly arranged turns, or intersecting and overlapping turns.

Subsequently, the limiting plate is removed from the sleeve 16, and an insulating paper 22 having a ring shape is placed on the front edges of the hold coil 13 and the pull coil 14. Then, the hold coil 13 and the pull coil 14 are placed in the yoke 11. The yoke 11 and the stationary core 12 are fixed to each other in a manner such that a combination of the hold coil 13, the pull coil 14, the insulating ring 21, and the insulating paper 22 are compressed and held between the yoke bottom 11*a* and the stationary core 12. Specifically, a packing 23 is placed on the rear surface of the stationary core 12, and a switch cap 24 is placed on the packing 23. The rear edge 11*c* of the cylindrical wall of the yoke 11 is pressed and bent inward into engagement with the switch cap 24. Thereby, the yoke 11, the stationary core 12, and the switch cap 24 are fixed to each other.

It should be noted that the insulating paper 22 may be replaced by an insulating member made of the same material as that in the insulating ring 21.

The plunger shaft 15 includes a bar made of magnetic metal such as iron. The plunger shaft 15 coaxially extends through the sleeve 16. The plunger shaft 15 is slidably supported by the sleeve 16. The plunger shaft 15 can move relative to the sleeve 16 along the axial direction. A front end of the plunger shaft 15 has an engagement projection 15*a* connected to the shift lever 25. A return spring 26 seated between a front face of the cylindrical portion 12*b* of the stationary core 12 and a shoulder 15*b* on the plunger shaft 15 urges the plunger shaft 15 frontward relative to the stationary core 12. When the hold coil 13 is de-energized so that a force of attracting the plunger shaft 15 disappears, the plunger shaft 15 is returned frontward by the return spring 26.

The switch portion 7 of the magnet switch 5 extends rearward of the magnet portion 6 thereof. The switch portion 7 has a movable contact 31, the switch cap 24, and fixed contacts 32 and 33. The movable contact 31 is placed on the rear end of the plunger shaft 15. Basically, the movable contact 31 moves together with the plunger shaft 15. The switch cap 24 has an inside chamber which accommodates the movable contact 31. The switch cap 24 is made of insulating material. The fixed contacts 32 and 33 are secured to the switch cap 24 at locations rearward of the movable contact 31. The movable contact 31 moves into and out of contact with the fixed contacts 32 and 33 in accordance with axial displacement of the plunger shaft 15. When the movable contact 31 moves into contact with the fixed contacts 32 and 33, the fixed contacts 32 and 33 are electrically connected to each other via the movable contact 31. When the movable contact 31 moves out of contact with the fixed contacts 32 and 33, the fixed contacts 32 and 33 are electrically disconnected from each other.

The movable contact 31 includes a plate of metal such as copper which has a low resistivity. A rear part of the plunger shaft 15 has a small-diameter portion 15*c* around which two insulating washers 34 and 35 are placed. The movable contact 31 is held between the washers 34 and 35, being supported on the plunger shaft 15. The washers 34 and 35 can slide on the small-diameter portion 15*c* in the axial direction. Thus, the movable contact 31 can slide on the small-diameter portion 15*c* in the axial direction. A snap ring 36 fitting on the rear end of the plunger shaft 15 can engage the washer 35 to prevent the separation of the washers 34 and 35 from the plunger shaft 15. A contact spring 37 seated between a shoulder 15*d* on the plunger shaft 15 and a front face of the washer 34 urges the movable contact 31 and the washers 34 and 35 rearward.

As the plunger shaft 15 moves rearward, the movable contact 31 moves together therewith and then meets the fixed contacts 32 and 33. After the movable contact 31 meets the fixed contacts 32 and 33, the plunger shaft 15 can further move rearward. Specifically, as the plunger shaft 15 further moves rearward, the washers 34 and 35 and the movable contact 31 slide frontward relative to the plunger shaft 15 against the force of the contact spring 37 while the movable contact 31 remains in electrical connection with the fixed contacts 32 and 33.

The switch cap 24 is made of thermosetting resin of an insulating type such as phenol resin. The switch cap 24 is attached to the yoke 11 and the stationary core 12. Specifically, the packing 23 is provided between the rear surface of the stationary core 12 and the front end of the switch cap 24. The rear edge 11*c* of the cylindrical wall of the yoke 11 is pressed and bent inward into engagement with the switch cap 24. Thereby, the yoke 11, the stationary core 12, and the switch cap 24 are connected together.

The fixed contacts 32 and 33 are made of metal such as copper. When the movable contact 31 meets the fixed contacts 32 and 33 in accordance with rearward movement of the plunger shaft 15, the fixed contacts 32 and 33 are electrically connected to each other. The fixed contacts 32 and 33 are provided with bolts 32*a* and 33*a* respectively. The bolts 32*a* and 33*a* extend through the walls of the switch cap 24. Nuts or washers 38 and 39 in mesh with the bolts 32*a* and 33*a* engage the outer surface of the switch cap 24, attaching the fixed contacts 32 and 33 to the switch cap 24. As shown in FIG. 1, the fixed contact 32 is electrically connected to the positive terminal of the battery 18. The fixed contact 33 is electrically connected to the end 14*b* of the pull coil 14 and the positive input terminal of the starter motor 4.

The starter 1 including the magnet switch 5 operates as follows. When the starter switch 17 is closed or changed to an ON position, both the hold coil 13 and the pull coil 14 are energized by the battery 18 so that the hold coil 13 and the pull coil 14 generate magnetic forces which attract the plunger shaft 15 rearward against the force of the return spring 26. The rearward displacement of the plunger shaft 15 rotates the shift lever 25, moving the pinion 3 into contact with the ring gear 2. Then, the rearward displacement of the plunger shaft 15 causes the movable contact 31 to meet the fixed contacts 32 and 33. As a result, the fixed contacts 32 and 33 are electrically connected by the movable contact 31, and a great electric current flows from the battery 18 to the starter motor 4 via the fixed contact 32, the movable contact 31, and the fixed contact 33. Thus, the starter motor 4 is fully energized so that the pinion 3 is rotated by the starter motor 4. As a result of the rotation of the pinion 3, the pinion 3 falls into complete mesh with the ring gear 2. Then, the ring gear 2 rotates together with the pinion 3, cranking the output shaft (the crankshaft) of the engine. When the fixed contacts 32 and 33 are electrically connected by the movable contact 31, the electric current bypasses the pull coil 14 so that the pull coil 14 is de-energized. On the other hand, the hold coil 13 continues to be energized so that the hold coil 13 maintains the generation of a magnetic force of attracting the plunger shaft 15.

When the engine starts and the starter switch 17 is changed to an OFF position, the hold coil 13 is de-energized. Accordingly, there occurs disappearance of the attracting magnetic force generated by the hold coil 13. Thus, the plunger shaft 15 is returned forward by the force of the return spring 26. The return of the plunger shaft 15 rotates back the shift lever 25, moving the pinion 3 out of mesh with the ring gear 2. The return of the plunger shaft 15 causes the movable contact 31 to separate from the fixed contacts 32 and 33. As a result, the fixed contacts 32 and 33 are electrically disconnected from each other, and hence the starter motor 4 is de-energized. The rotation of the pinion 3 stops when the starter motor 4 is de-energized. In this way, the starter 1 is deactivated.

This embodiment has features as follows. In the magnet switch 5, the hold coil 13 and the pull coil 14 have regular windings respectively. The hold coil 13 and the pull coil 14 are placed around the non-magnetic metal sleeve 16 without providing any bobbin between the sleeve 16 and the coils 13 and 14. The hold coil 13 and the pull coil 14 are compressed and held between the yoke bottom 11*a* and the stationary core 12. Elasticity of the hold coil 13 and the pull coil 14, which are being compressed, enables the coils 13 and 14 to be firmly held between the yoke bottom 11*a* and the stationary core 12.

The insulating ring 21 is provided between the stationary core 12 and the combination of the hold coil 13 and the pull coil 14. The insulating paper 22 is provided between the yoke bottom 11*a* and the combination of the hold coil 13 and the pull coil 14. The thicknesses of the insulating ring 21 and the insulating paper 22 are preferably set to small values. Accordingly, it is possible to attain adequate axial dimensions of the hold coil 13 and the pull coil 14 which are located between the yoke bottom 11*a* and the stationary core 12. Specifically, it is possible to set the spatial dimensions of the hold coil 13 and the pull coil 14, in the axial direction, greater than those in a prior-art design. This is advantageous in generating great magnetic forces by the hold coil 13 and the pull coil 14.

As previously described, the hold coil 13 and the pull coil 14 are placed around the non-magnetic metal sleeve 16 without providing any bobbin between the sleeve 16 and the coils 13 and 14. The absence of such a bobbin makes it possible to attain adequate radial dimensions of the hold coil 13 and the pull coil 14. This is advantageous in generating great magnetic forces by the hold coil 13 and the pull coil 14. Further, the absence of a bobbin results in a reduction of the number of parts of the magnet switch 5. The magnet switch 5 can be miniaturized.

As previously described, the insulating ring 21 is provided between the stationary core 12 and the combination of the hold coil 13 and the pull coil 14. The insulating paper 22 is provided between the yoke bottom 11*a* and the combination of the hold coil 13 and the pull coil 14, The insulating ring 21 and the insulating paper 22 are preferably made of materials having small rates of deformation (creep) responsive to temperature variations. In this case, the insulating ring 21 and the insulating paper 22 are hardly deformed when being heated by the energization of the hold coil 13 and the pull coil 14. Accordingly, the hold coil 13 and the pull coil 14 continue to be firmly held between the yoke bottom 11*a* and the stationary core 12 while being prevented from moving axially.

The sleeve 16 is made of non-magnetic electrically-conductive metal. As previously described, the sleeve 16 has the engagement portion 16*a* formed with the hole. During the assembly of the hold coil 13, one end 13*a* of the hold coil 13 is passed through the hole in the engagement portion 16*a*, being caught by the engagement portion 16*a*. At this time, a part of the coating peels from the electric wire for the hold coil 13 so that the end 13*a* of the hold coil 13 is electrically connected to the sleeve 16. Thus, the assembly of the hold coil 13 is relatively easy and simple. The end 13*a* of the hold coil 13 is grounded via the sleeve 16. Accordingly, it is unnecessary to electrically connect the hold coil 13 with the stationary core 12.

It should be noted that only one of the hold coil 13 and the pull coil 14 may be disposed in the yoke 11.

What is claimed is:

1. A magnet switch for an engine starter, comprising:

a yoke made of magnetic material and having a cylindrical shape with a bottom and an opening:

a coil disposed in the yoke and including an insulated electric wire;

a stationary core being made of magnetic material and closing the opening of the yoke;

a sleeve made of non-magnetic metal and having a cylindrical shape, the sleeve being located between the bottom of the yoke and the stationary core; and a plunger made of magnetic material and being at least partially located in the sleeve, the plunger being slidable relative to the sleeve in an axial direction;

wherein the insulated electric wire in the coil directly abuts the sleeve, and the coil is compressed and held between the bottom of the yoke and the stationary core.

2. The magnet switch of claim 1, further comprising an insulating member provided at one of a first location between the coil and the bottom of the yoke and a second location between the coil and the stationary core, the insulating member having a small rate of deformation responsive to a temperature variation.

3. The magnet switch of claim 1, wherein the sleeve is made of electrically conductive metal and has an engagement projection, and the sleeve is electrically grounded, and wherein an end of the electric wire in the coil is electrically connected to the engagement projection of the sleeve to be electrically grounded via the sleeve while an insulating cover peels from the end of the electric wire.

* * * * *